US009114432B2

(12) United States Patent
Mori

(10) Patent No.: US 9,114,432 B2
(45) Date of Patent: Aug. 25, 2015

(54) DEVICE FOR SORTING AND CONVEYING DOCUMENTS

(71) Applicant: Kabushiki Kaisha Toshiba, Tokyo (JP)

(72) Inventor: Hidenari Mori, Kanagawa (JP)

(73) Assignee: KABUSHIKI KAISHA TOSHIBA, Tokyo (JP)

( * ) Notice: Subject to any disclaimer, the term of this patent is extended or adjusted under 35 U.S.C. 154(b) by 0 days.

(21) Appl. No.: 13/898,956

(22) Filed: May 21, 2013

(65) Prior Publication Data

US 2014/0117615 A1 May 1, 2014

(30) Foreign Application Priority Data

Oct. 25, 2012 (JP) ..... 2012-235590

(51) Int. Cl.
*B65H 29/58* (2006.01)
*B07C 5/00* (2006.01)

(52) U.S. Cl.
CPC *B07C 5/00* (2013.01); *B65H 29/58* (2013.01); *B65H 2301/312* (2013.01); *B65H 2301/448* (2013.01); *B65H 2301/44316* (2013.01); *B65H 2404/25* (2013.01); *B65H 2404/252* (2013.01); *B65H 2404/261* (2013.01); *B65H 2404/2691* (2013.01); *B65H 2404/63* (2013.01); *B65H 2515/81* (2013.01); *B65H 2701/1916* (2013.01)

(58) Field of Classification Search
CPC .... B65H 29/58; B65H 29/60; B65H 2301/31; B65H 2301/312; B65H 2301/3124; B65H 2301/341; B65H 2301/4431; B65H 2301/44312; B65H 2301/44316; B65H 2301/4455; B65H 2301/4432; B65H 2301/44322; B65H 2301/443246; B65H 2404/1532; B65H 2404/252; B65H 2404/253; B65H 2404/2531; B65H 2404/2532; B65H 2404/254; B65H 2404/255; B65H 2404/261; B65H 2404/63; B65H 2404/632; B65H 2404/633; B65H 2404/693; B65H 2404/694; B65H 2301/448
USPC ..... 271/287–290, 297–299, 302, 303, 305, 271/273, 274
See application file for complete search history.

(56) References Cited

U.S. PATENT DOCUMENTS

| | | | | | |
|---|---|---|---|---|---|
| 3,724,657 | A * | 4/1973 | Katagiri et al. | ..... | 271/301 |
| 3,955,812 | A * | 5/1976 | Suda et al. | ..... | 271/286 |
| 4,441,704 | A * | 4/1984 | Uchida et al. | ..... | 271/303 |
| 5,108,086 | A * | 4/1992 | Seeber | ..... | 271/303 |
| 5,150,894 | A * | 9/1992 | Ricciardi | ..... | 271/302 |
| 5,467,976 | A * | 11/1995 | Doucet | ..... | 271/302 |
| 5,490,666 | A * | 2/1996 | Albert | ..... | 270/5.01 |
| 6,176,485 | B1 * | 1/2001 | Wingate | ..... | 271/303 |
| 8,069,968 | B2 * | 12/2011 | Zimmermann | ..... | 198/369.2 |

FOREIGN PATENT DOCUMENTS

JP 09-030707 2/1997

* cited by examiner

*Primary Examiner* — Ernesto Suarez
(74) *Attorney, Agent, or Firm* — Patterson & Sheridan, LLP

(57) ABSTRACT

According to one embodiment, the guide roller, which faces the sorting gate mediated by the conveyor belt and guides the travel of the conveyor belt, and the position determination unit, which gives an elastic bias to the guide roller and positions it to the predefined position, are provided. The guide roller receives a pushing pressure from documents that are held and conveyed by the conveyor belts and then retracts from the predefined position while resisting the bias of the position determination unit.

20 Claims, 5 Drawing Sheets

DEVICE FOR SORTING AND CONVEYING DOCUMENTS

CROSS-REFERENCE TO RELATED APPLICATION

This application is based upon and claims the benefit of priority from Japanese Patent Application No. 2012-235590, filed Oct. 25, 1212; the entire contents of which are incorporated herein by reference.

FIELD

Embodiments described herein relate to a device for sorting and conveying documents.

BACKGROUND

A device for sorting and conveying documents is provided in a document sorting and conveying machine, and a mail sorting machine, which sorts documents from a single conveying path and feeds the documents to a plurality of conveying units after sorting.

In the device for sorting and conveying documents, there is a switching gate in between one conveying path and a plurality of conveying units. Documents are sorted and conveyed to a plurality of conveying paths by selectively determining, and when required, switching the conveying direction for each of the documents through the operation of a switching gate.

However, due to restrictions of the thickness and fragility of documents, there is a problem properly sorting the documents. The problem is based on the premise that when documents are held and conveyed, the switching gate used for sorting may significantly bend the documents.

Sorting documents, without significant bending thereof, can be accomplished by providing a large gap between the desired conveying path wherein the document destination is desired and the remaining conveying paths. However, conveyance stability i.e., the state of continued operation without pausing to remove a stuck document or the misdirecting or dropping of a document, is often compromised because of the difficulty in reliably directing the documents where a large gap is provided.

DETAILED DESCRIPTION

In general, embodiments will be explained below with reference to the drawings.

An embodiment includes: a conveying unit that holds and conveys documents using a travelling conveyor belt, a sorting gate that sorts the documents held and conveyed by the conveyor belt in a first direction or in a second direction that is different from the first direction, a guide roller, provided so as to face the sorting gate mediated by the conveyor belt therebetween, and guide the travel of the conveyor belt, and a position determination unit that determines the position of a predefined position by giving elastic bias to the guide roller. The guide roller moves to a retracted position from the predefined position by receiving a pushing pressure from documents that are held and conveyed by the conveyor belt, while resisting a bias exerted thereon from the position determination unit.

Figure 1:
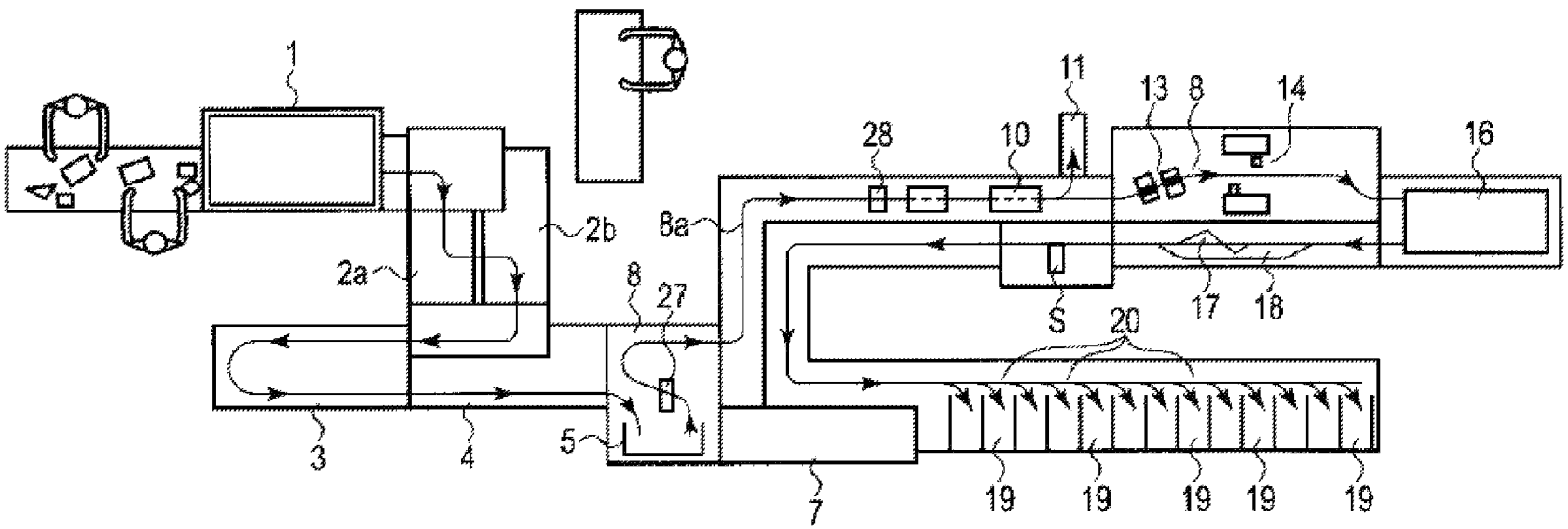
FIG. 1 is a configuration diagram in plan or top view illustrating configuration or layout of an apparatus for processing mail articles, according to one embodiment.

FIG. 1 illustrates a top view of an apparatus for processing mail articles according to one embodiment.

Mail articles such as postcards or the like are taken out from mail bags, which have been collected or posted and placed therein, and the articles are dumped into a hopper 1. Mail articles, which are dumped into the hopper 1, include both standard-size mails that can be machine-processed and nonstandard-size mails that cannot be machine-processed.

A thickness sorting section 2*a* and a width sorting section 2*b* are connected to the hopper 1. The thickness sorting section 2*a* and the width sorting section 2*b* cull mail articles which are thicker than a predefined thickness and are wider than a predefined width and therefore only allow standard-size mail articles to pass therethrough.

A displacing section 3 that displaces overlapping mail articles is connected to the thickness sorting section 2*a* and the width sorting section 2*b*; and a single piece or article dispenser section 4 that dispenses therefrom a single mail article is connected to the displacing section 3. A buffer feeder section 5 that collects and feeds mail articles is connected to the single article dispenser section 4. The buffer feeder section 5 includes a local feeder section 7 connected into the flowstream, into which standard-size mail articles aligned by human hands, i.e., manually, are added to the flow of articles being sorted.

The buffer feeder section 5 dispenses a single standard-size mail article and discharges it to a conveying path 8 in an upright position. A position controlling section 10 that corrects the position of the mail article is provided in the middle of the conveying path 8. A clearing section 11 that culls and collects mail articles that are not properly positioned is provided at the side of discharging of the mail articles from the position controlling section 10.

A first reading unit 13 and a second reading unit 14 are arranged in a direction of conveyance of the mail articles. Mail articles, which are not culled by the clearing off section 11, have both sides thereof scanned by the first reading unit 13, and subsequently, the second reading unit 14 again scans both sides of the mail articles.

A switch back section 16 aligns the orientation of mail articles according to the types of postage or location information on mail articles and is connected to the discharging side of the second reading unit 14. A reverse controlling section 17 that inverts the top and bottom of mail articles, a normal rotation controlling section 18, and a postmarking section S that prints postmarks on the stamps on mail articles are all connected to the discharging side of the switch back section 16.

A plurality of stacker sections 19 are connected to the discharging side of the postmarking section S; mail articles are sorted and stacked in the stacker sections 19 according to the information of the scanned image obtained by the first reading unit 13 and the second reading unit 14.

A more detailed explanation of the mail handling operation of the apparatus for processing mail articles follows.

Firstly, mail articles are taken out from mail bags containing collected and/or posted mail and put into the hopper 1. Mail articles put in the hopper 1 are fed to the thickness sorting section 2*a* and width sorting section 2*b* and sorted by thickness and width. Mail articles thicker than a predefined thickness and wider than a predefined width are culled from the mail processing workstream, and only standard-size mail articles (those which can be auto-processed) remain. When these standard-size mail articles overlap one another, the overlapping mail articles are displaced by the displacing section 3 and then each mail article is singly dispensed from the single dispenser section 4. These dispensed mail articles which are of a size that can be machine sorted are fed to the buffer feeder section 5. Additional mail articles may be fed from the local feeder section 7 to the buffer feeder section 5. After the feeding, each mail article is singly dispensed from the buffer feeder section 5 and fed to the conveying path 8. The positions of the standard-size mail articles fed to the conveying path 8 are aligned by passing the articles through the position controlling section 10. Mail articles whose positions are not corrected are culled from the workstream and loaded into a stacker. Mail articles which are not culled are scanned by the first reading unit 13 on both sides article, followed by reading both sides of the article in the second reading unit 14. After scanning, the mail articles pass through the switch back section 16 that aligns the mail articles, or are conveyed without being switched back, and reversed by the reverse controlling section 17 (if they need to be repositioned for receipt in the stacker 19), or pass through the normal rotation controlling section 18. Consequently, the positions of stamps or the like on the mail articles are aligned, and postmarks are printed on those stamps or the like by the postmarking section S. After postmarking, the mail articles are sorted and accumulated in the stacker sections 19 based on the image scanning information indicating the destination thereof which was scanned by the first reading unit 13 and the second reading unit 14.

Figure 2:
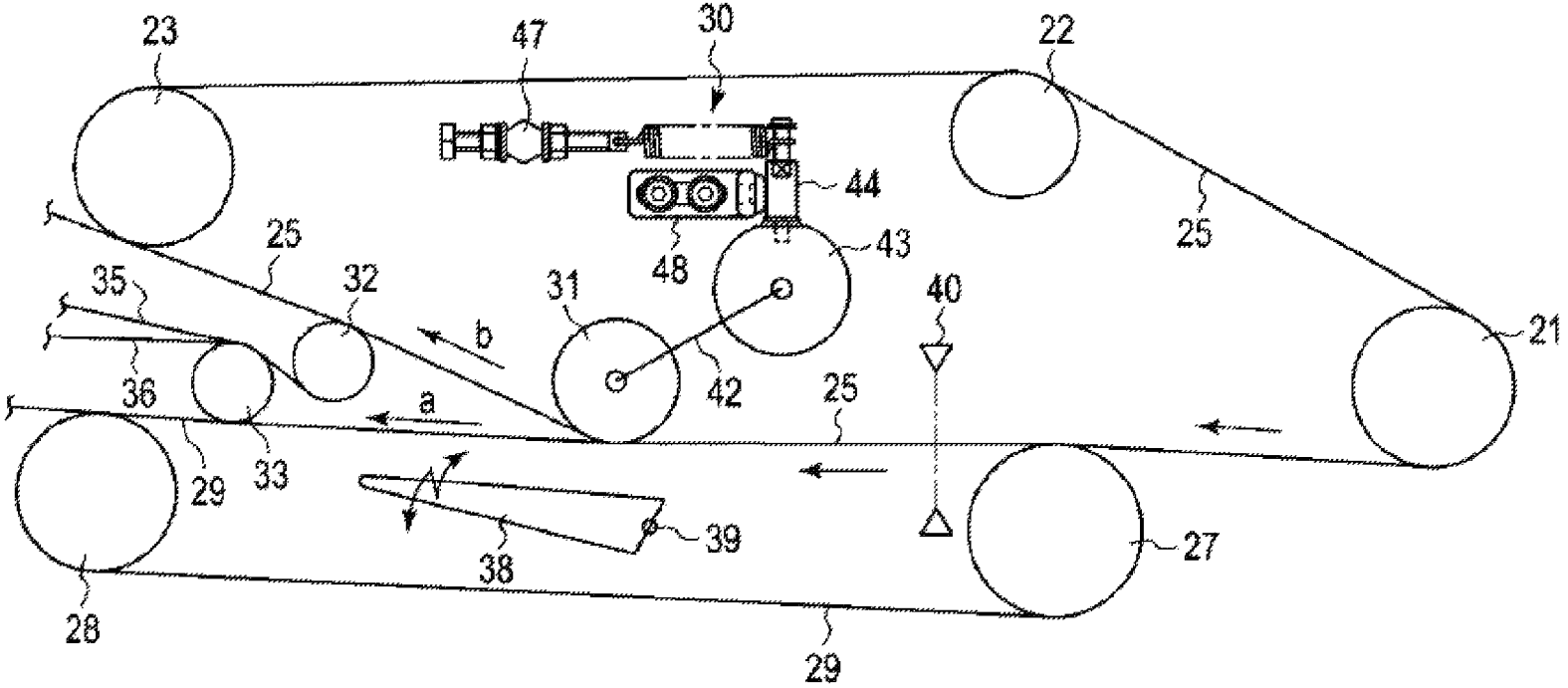
FIG. 2 is an illustration of a device for sorting and conveying in FIG. 1.

FIG. 2 illustrates a top view of a device for sorting and conveying 20 that is positioned at the article input location of the plurality of stacker sections 19 of FIG. 1.

The device for sorting and conveying 20 transports articles based on the image scanning information related to the article; the device implements a direction of conveyance of the mail articles, and directs the mail articles to the appropriate stacker section 19 based on the image scanning information for the article. To transport the mail articles, a plurality of belts, which may be brought together to secure the articles therebetween, are provided. By moving the adjacent portion of the belts in the same direction, the mail articles are moved therewith. Where the belts diverge from contact with one another, the mail article may be removed from the workstream or directed to additional abutting belts for further transport thereof.

The device for sorting and conveying 20 has a first conveyor belt 25 extending across opposed roller 21 to 23, which moves in a direction of the arrow b. The device for sorting also has a second conveyor belt 29 that, together with the first conveyor belt 25 holds and conveys the mail articles.

The first conveyor belt 25, at a position intermediate of roller 21 and roller 23, is biased by a guide roller 31. This guide roller 31 is supported by a supporting device 30, which will be described herein.

A portion of the first conveyor belt 25 and the second conveyor belt 29 are positioned to push against one another for the conveyance of mail articles in a space therebetween, and they part from each other adjacent to the position where the guide roller 31 is engaged against the interior of the first conveyor belt 25. In the space between the belts 25, 29 after the location where they part, roller 32 and roller 33 are positioned. A third conveyor belt 35 extends around roller to engage against a portion of first conveyor belt extending between rollers 23 and 31, and thus together with the first conveyor belt 25 can selectively hold and convey mail articles conveyed thereto by the conveyor belts 25, 29. A roller 33 has a fourth conveyor belt 36 extending thereabout that together with the second conveyor belt 29, can also hold and convey mail articles emerging from the conveyor belts 25, 29.

A sorting lever is arranged between roller 27 and roller 28, within the interior of second belt 29 and adjacent to e guide roller 31 pressing the first conveyor belt 25 against the second conveyor belt 29. This sorting lever 38 is provided on a support shaft 39 so as to be freely pivotable thereon, the pivoting of which enables switching the mail articles to the first direction shown by the arrow a, or to the second direction shown by the arrow b.

The mail articles moved in the direction shown by the arrow a, after passing the location of guide roller 31, and thus after passing the location where belts 25, 29 diverge, are held between and further conveyed between the second conveyor belt 29 and the fourth conveyor belt 36. Mail articles may also move in the second direction shown by the arrow b conveyed between the first conveyor belt 25 and the third conveyor belt 35 after passing the location where belts 25 and 29 diverge.

A detection sensor 40 is provided at the carrying-in side of the sorting lever 38 of the mail articles. The sorting lever 38 is designed to function depending on the scanned sorting information upon detecting the mail articles by the detection sensor 40, and in conjunction with belt 29, create a gate to direct the mail articles after they pass the location where belts 25 and 29 diverge.

Figure 3:
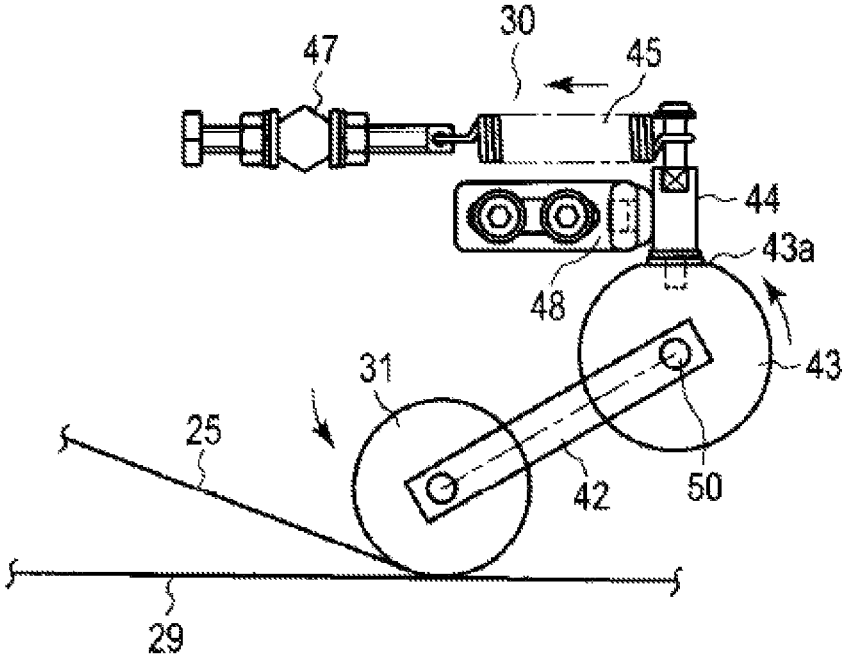
FIG. 3 is an illustration of a supporting device for a guide roller of the conveyor belt in FIG. 2.

FIG. 3 illustrates a configuration of the supporting device 30 as a position determination unit of the guide roller 31 described above.

The guide roller 31 is supported at one end of a supporting lever arm 42 so as to freely rotate. The other end portion of the supporting lever arm 42 is connected to the axle of a holding shaft 50 of a rotating roller 43; the holding shaft 50 is supported by, and rotates freely in, a device frame whose illustration is omitted.

A flat surface 43*a* is formed at the peripheral portion of the rotating roller 43, and a fixture 44 is arranged as a protruding element on the flat surface 43*a*. One end portion of a coil spring 45 is attached to the upper end portion of the fixture 44; while the other end portion is attached to a fixed retainer 47.

In addition, a stop 48 is provided below the coil spring 45. The stop limits the retracted position of the fixture 44 when retracted by the spring 45. In the configuration described above, when the roller 43 rotates counterclockwise as shown by the arrow in FIG. 3, with the bias provided from the coil spring 45, the supporting lever arm 42 swings in a counterclockwise direction, causing movement of the guide roller 31. The guide roller 31 will reach the predefined limit or stop position when the fixture 44 contacts stop 48 such that further rotation of roller 43, and thus movement of roller 31 in the direction of belt 29, stops.

Figure 4:
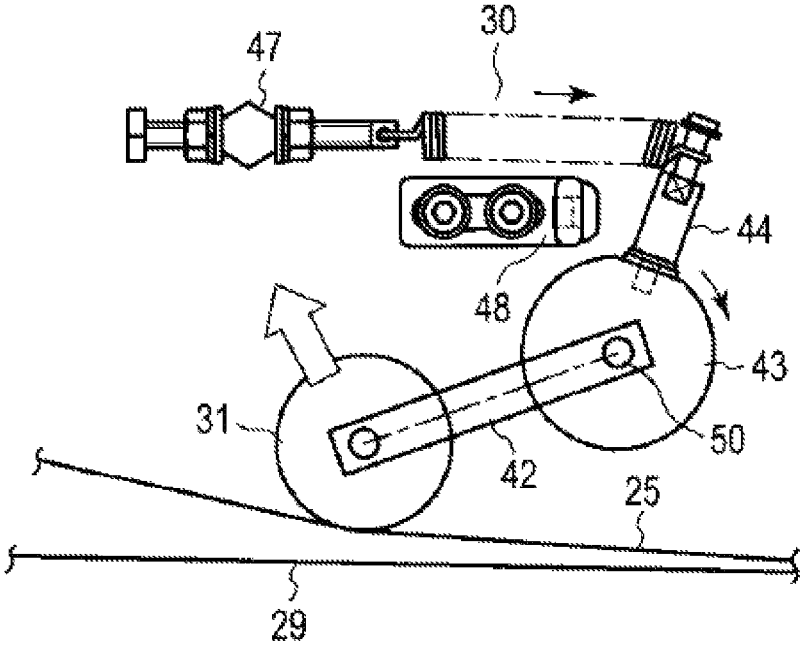
FIG. 4 is an illustration of the guide roller in FIG. 3 in the state of being retracted upward.

The coil spring 45 supplies force to bias the fixture 44 against stop 48, which tends to maintain the rollers in the position shown in FIG. 3. In addition, starting from the state shown in FIG. 3, when the guide roller 31 is caused by an external force supplied by a thick or rigid mail article to be biased in the direction away from the belt 29, as shown by the arrow extending from roller 31 in FIG. 4, e rotating roller 43 moves against the bias of the coil spring 45 and rotates clockwise, while anchored to the holding shaft 50. Thus the lever arm swings in the direction of the arrow and the guide roller 31 then retracts away from the belt 29, and a further portion or extent of the belt 25 pulls away from belt 29 as compared to when a thin pliable mail article passed. The handling operation of the device for sorting and conveying configured as above will be explained next.

Figure 5:
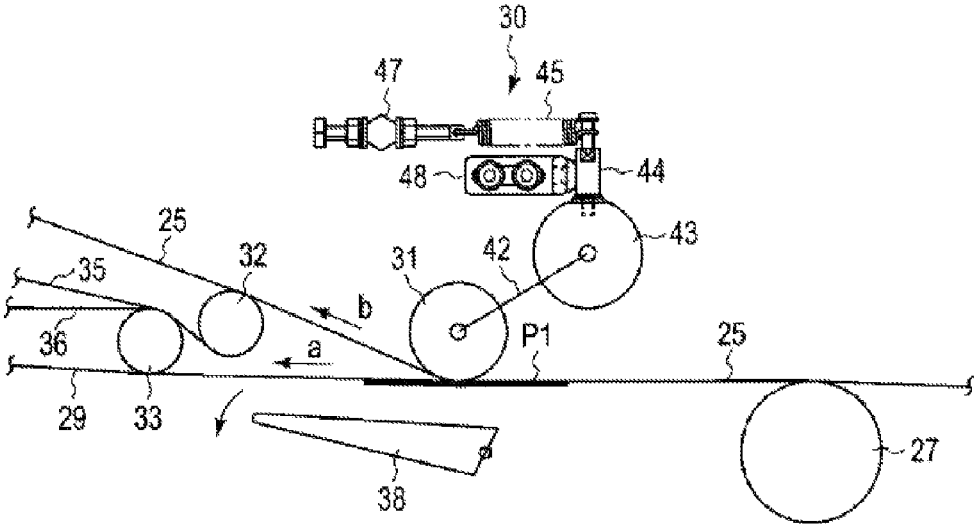
FIG. 5 is an illustration of a sorting and conveying device of FIG. 2 sorting a thin mail article to a first direction.

First, in order to convey a thin mail article P1 in the first direction shown by the arrow a as illustrated in FIG. 5, the sorting lever 38 swings in a counterclockwise direction as shown by the arrow, and the mail article P1 is held and conveyed by and between the second conveyor belt 29 and the fourth conveyor belt 36.

Figure 6:
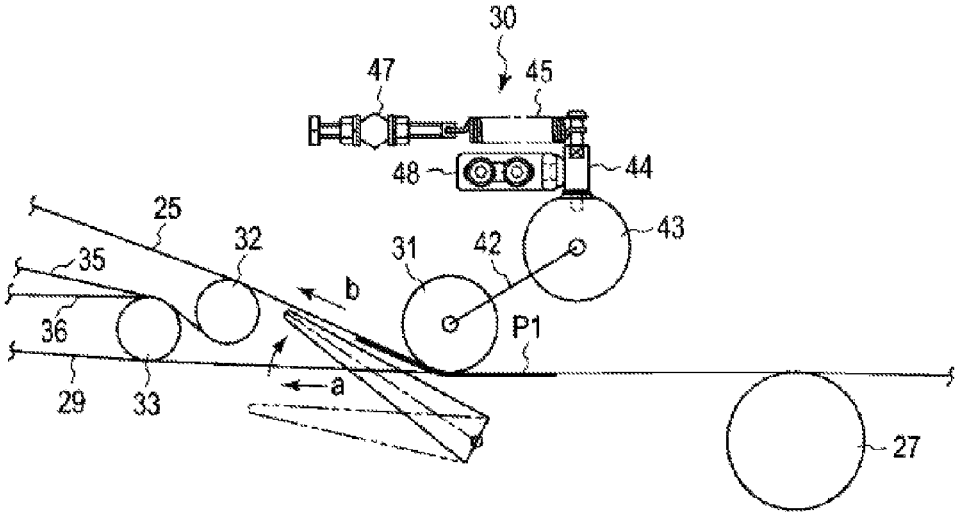
FIG. 6 is an illustration of a sorting and conveying device of FIG. 2 sorting a thin mail article to a second direction.

When conveying the thin mail article P1 in the second direction shown by the arrow b as illustrated in FIG. 6, the sorting gate 38 rotates in a clockwise direction as shown by the curved arrow. Consequently, the mail article P1 is bent by the guide roller 31 and the conveying direction is switched to the second direction; the mail article is then held between and conveyed by and between the first conveyor belt 25 and the third conveyor belt 35.

Figure 7:
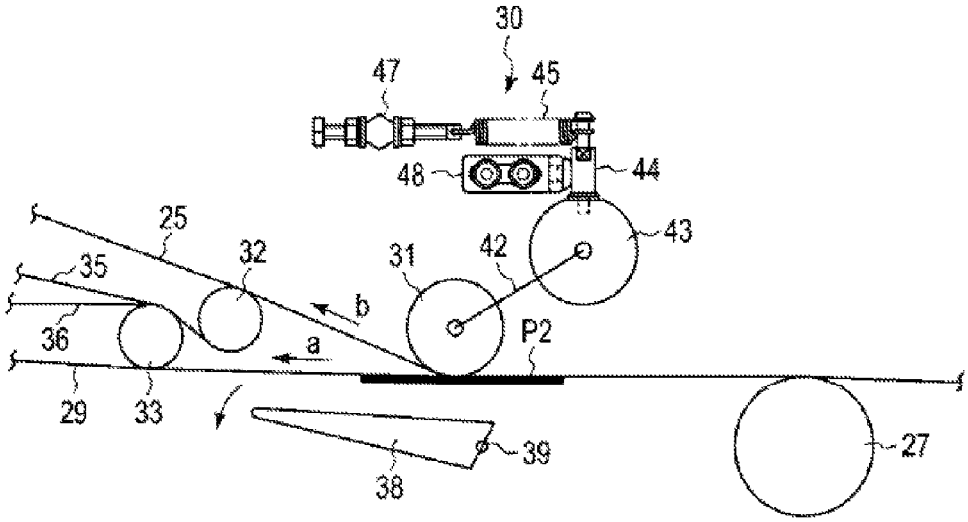
FIG. 7 is an illustration of a sorting and conveying device of FIG. 2 sorting a thick mail article to a first direction.

When conveying a thick mail article P2 in the first direction shown by the arrow a as illustrated in FIG. 7, sorting lever 38 rotates in (or is maintained at) a counterclockwise direction as shown by the arrow, and the thick mail article P2 is held and conveyed in the first direction by the second conveyor belt 29 and the fourth conveyor belt 36.

Figure 8:
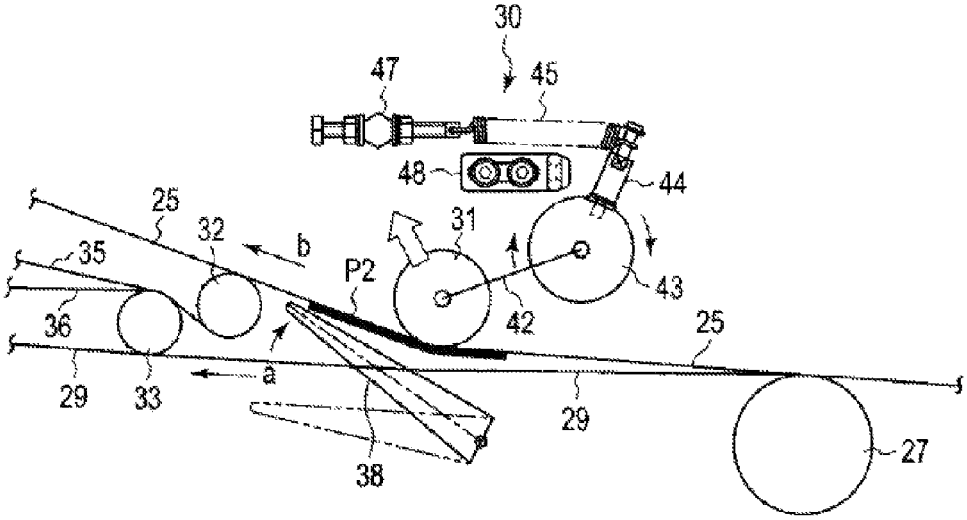
FIG. 8 is an illustration of a sorting and conveying device of FIG. 2 sorting a thick mail article to a second direction.

When sorting and conveying the thick mail article P2 in the second direction shown by the arrow b as illustrated in FIG. 8, the sorting lever 38 rotates in a clockwise direction as shown by the arrow, and the thick mail article P2 is pushed towards the guide roller 31 because the thicker mail article is stiffer, i.e., not as easily bent as a thin mail article. Consequently, the guide roller 31 is moved in a direction shown by the arrow and retracted from the predefined position. The supporting lever arm 42 and the rotating roller 43 swing in the direction shown by the arrow against the reverse directed bias of the coil spring 45.

In case the mail articles are significantly thin or soft when being sorted and conveyed in the second direction shown by the arrow b above, the guide roller 31 stays at or close to the predefined position because the mail article is easily bent.

However, in case the mail articles are thick or something rigid such as plastic is in the mail article, there arises problems such as the mail articles are damaged by being excessively bent or the conveyor belt is damaged, if the guide roller 31 is maintained at the at the predefined position.

In the present embodiment, when the mail articles are thick or rigid, as illustrated in FIG. 8, the guide roller 31 moves and retracts from the predefined position as shown by the arrow; there is thus an advantage of preventing damaging the mail articles P2 by excessive bending or damaging the first conveyor belt 25.

In addition, conveyance stability can be successfully maintained, because there arises no occurrence in which documents cannot be steadily held when sorting.

While certain embodiments have been described, these embodiments have been presented by way of example only, and are not intended to limit the scope of the inventions. Indeed, the novel embodiments described herein may be embodied in a variety of other forms; furthermore, various omissions, substitutions and changes in the form of the embodiments described herein may be made without departing from the spirit of the inventions. The accompanying claims and their equivalents are intended to cover such forms or modifications as would fall within the scope and spirit of the inventions.

What is claimed is:

1. A device for sorting and conveying at least one document, comprising:

a conveying unit having a conveyor belt configured to convey a document;

a sorting lever configured to move to change a conveyance direction of the document conveyed by the conveyor belt, and thus direct the document conveyed by the conveyor belt toward a first direction or toward a second direction;

a guide roller configured to guide the conveyor belt and positioned on an opposed side of the conveyor belt from the sorting lever and moveable between a first position and a second position; and a position determination unit configured to bias the guide roller to the first position, wherein:

when the conveyance direction of the document is the second direction, the guide roller is moved towards the second position if a pushing pressure is exerted on the guide roller by the document conveyed by the conveyor belt and the guide roller is not moved towards the second position if a pushing pressure is not exerted on the guide roller by the document conveyed by the conveyor belt, and movement of the sorting lever does not move the guide roller.

2. The device for sorting and conveying documents according to claim 1, wherein the position determination unit comprises:

an interlocking member configured to interlock with a movement of the guide roller; and a biasing member configured to predispose the guide roller at the first position by biasing the interlocking member elastically.

3. The device for sorting and conveying documents according to claim 2, wherein the interlocking member comprises:

a supporting lever arm with a first end and a second end, wherein the guide roller is supported at the first end thereof; and a rotating roller configured to connect the second end of the supporting lever arm which is moveable around a holding shaft, wherein the supporting lever arm swings in both a clockwise and a counter clockwise direction centered around the holding shaft, and the rotating roller swings along with the supporting lever arm around the holding shaft.

4. The device for sorting and conveying documents according to claim 3, wherein a protruding element integral to and projecting perpendicularly from a peripheral portion of the rotating roller, is configured to radially move with a rotation of the rotating roller; and the guide roller is moveable to a position between, and up to, the second position and the first position in response to the supporting lever arm rotating by bias of the rotating roller.

5. The device for sorting and conveying documents according to claim 4, further comprising:

a stop to contact the protruding element, which moves and is biased by the biasing member, to limit the guide roller at the first position.

6. The device for sorting and conveying documents according to claim 2 wherein the biasing member is a spring.

7. The device for sorting and conveying documents according to claim 2 wherein the pushing pressure from the documents is provided by a document thickness in conjunction with the sorting lever.

8. A method for sorting and conveying a document, the method comprising:

conveying the document between a first conveyor belt and a second conveyor belt;

with a sorting lever, changing a travel direction of the document from a first travel direction to a second travel direction with respect to the first and second conveyor belts;

moving a guide roller that guides a portion of the first conveyor belt opposed to the sorting lever from a first position in which the guide roller is biased against the second conveyor belt to a second position in which the guide roller is spaced from the second conveyor belt, the guide roller being moved to the second position in response to a force imparted on the guide roller from the document conveyed between the conveyor belts, wherein the guide roller is not moved from the first position when a force is not imparted on the guide roller from the document conveyed between the conveyor belts, and the sorting lever does not move the guide roller when the sorting lever changes the travel direction.

9. The method for sorting and conveying documents according to claim 8, further comprising:

interlocking movement of the guide roller with an interlocking member; and biasing the guide roller to the first position by biasing the interlocking member elastically.

10. The method for sorting and conveying documents according to claim 9, wherein biasing the guide roller comprises:

providing a lever arm having a first end and a second end, wherein the guide roller is supported at the first end thereof; and pivoting a rotation roller connected to the second end of the lever arm and supported by a holding shaft; wherein the lever arm is able to pivot in both a clockwise and a counter clockwise direction centered on a holding shaft, and the rotation of the roller swings the lever arm through an arc around the holding shaft.

11. The method for sorting and conveying documents according to claim 10, wherein a protruding element is integral to and projects outwardly from a peripheral portion of the rotation roller, and arcuately moves with the rotation roller.

12. The method for sorting and conveying documents according to claim 11, further comprising:

after there is no longer a force imparted on the guide roller from the document conveyed between the conveyor belts, moving the guide roller to the first position from the second position in response to biasing of the protruding element of the rotation roller connected to the guide roller.

13. The method for sorting and conveying documents according to claim 12, further comprising:

limiting motion of the protruding element moving from the second position to the first position, which is biased by a biasing member and moves, with a stop.

14. The method for sorting and conveying documents according to claim 9, wherein the biasing is performed by a spring.

15. The method for sorting and conveying documents according to claim 9, wherein the force imparted on the guide roller is provided by a document being biased in a direction of the biasing roller, in a workflow downstream position, by the sorting lever.

16. An apparatus for sorting and conveying documents, comprising:

a conveying unit having a conveyor belt configured to convey a document;

a sorting gate configured to selectively direct the document conveyed by the conveyor belt towards a first destination or towards a second destination;

a guide roller, disposed across the conveyor belt from the sorting gate, configured to guide the conveyor belt;

a position determination unit configured to provide an elastic bias to the guide roller to bias the guide roller towards a first position, wherein the guide roller is moveable towards a second position in response to a force imparted on the guide roller from the document being conveyed by the conveyor belt;

an interlocking member that interlocks with a movement of the guide roller, the interlocking member including:

a supporting lever arm with a first end and a second end, wherein the guide roller is supported at the first end, and a rotatable roller supported by a holding shaft connected to the second end of the supporting lever arm, wherein the supporting lever arm may move in both a clockwise and a counter clockwise direction centered around the holding shaft, the rotatable roller being rotatable on the holding shaft; and a biasing member configured to position the guide roller by biasing the interlocking member elastically, wherein:

the guide roller moves from the first position, against an elastic bias from the position determination unit, in response to the force imparted on the guide roller by the document conveyed by the conveyor belt when the sorting gate directs the document towards the second destination, the guide roller does not move from the first position when no force is imparted on the guide roller by the document conveyed by the conveyor belt, and movement of the sorting gate does not move the guide roller.

17. The apparatus for sorting and conveying documents according to claim 16, wherein a protruding element is integral to and projects radially from a peripheral portion of the rotatable roller, and arcuately moves with a rotation of the rotatable roller; and wherein the guide roller is moved by the supporting lever arm moved by the protruding element of the rotatable roller connected to and biased by the biasing member.

18. The apparatus for sorting and conveying documents according to claim 17, further comprising:

a stop to stop further motion of the protruding element and thus establish the position of the guide roller in the first position.

19. The apparatus for sorting and conveying documents according to claim 17 wherein the biasing member is a spring.

20. The apparatus for sorting and conveying documents according to claim 16 wherein the force imparted on the guide roller is provided by a document and by the sorting gate.

* * * * *